US011905954B2

(12) United States Patent
Mori et al.

(10) Patent No.: US 11,905,954 B2
(45) Date of Patent: Feb. 20, 2024

(54) ELECTRIC PUMP

(71) Applicants: KABUSHIKI KAISHA TOYOTA JIDOSHOKKI, Aichi-ken (JP); NOK CORPORATION, Tokyo (JP)

(72) Inventors: Tatsushi Mori, Kariya (JP); Shintaro Kashiwa, Kariya (JP); Daisuke Masaki, Kariya (JP); Kenichi Yoshimura, Tokyo (JP)

(73) Assignees: KABUSHIKI KAISHA TOYOTA JIDOSHOKKI, Aichi-ken (JP); NOK CORPORATION, Tokyo (JP)

( * ) Notice: Subject to any disclaimer, the term of this patent is extended or adjusted under 35 U.S.C. 154(b) by 189 days.

(21) Appl. No.: 17/546,556

(22) Filed: Dec. 9, 2021

(65) Prior Publication Data

US 2022/0186728 A1 Jun. 16, 2022

(30) Foreign Application Priority Data

Dec. 16, 2020 (JP) ..... 2020-208375

(51) Int. Cl.
*F04C 18/12* (2006.01)
*F04C 15/00* (2006.01)
(Continued)

(52) U.S. Cl.
CPC ..... *F04C 18/126* (2013.01); *F01C 1/084* (2013.01); *F01C 1/126* (2013.01); *F01C 19/005* (2013.01);
(Continued)

(58) Field of Classification Search
CPC ..... F04C 18/126; F04C 18/16; F04C 29/005; F04C 18/084; F04C 25/02; F04C 2240/30; F04C 27/009; F04C 29/02; F04C 15/0088; F04C 2/084; F04C 15/0038; F04C 18/086; F04C 27/00; F04C 28/24; F04C 2240/40; F04C 2240/60; F01C 1/126; F01C 1/084; F01C 1/16; F01C 19/005
See application file for complete search history.

(56) References Cited

U.S. PATENT DOCUMENTS 3,883,273 A * 5/1975 King ..... F04C 29/12 418/60
6,290,470 B1 9/2001 Okuno et al.
10,738,778 B2 * 8/2020 Hirano ..... F04C 18/082

FOREIGN PATENT DOCUMENTS

JP 2005-188326 A 7/2005
JP 2006-177299 A 7/2006
(Continued)

*Primary Examiner* — Peter J Bertheaud
(74) *Attorney, Agent, or Firm* — Greenblum & Bernstein, P.L.C.

(57) ABSTRACT

An electric pump includes a housing that includes a gear chamber, a rotor chamber, and a motor chamber. The electric pump includes a first seal member, a second seal member, and a third seal member. The first seal member seals a space between the gear chamber and the rotor chamber. The second seal member seals the space between the gear chamber and the rotor chamber. The third seal member seals a space between the gear chamber and the motor chamber. The third seal member seals the space between the gear chamber and the motor chamber to a lesser extent than the first seal member and the second seal member seal the space between the gear chamber and the rotor chamber.

12 Claims, 5 Drawing Sheets

(51) Int. Cl.

| | |
|---|---|
| ***F04C 2/08*** | (2006.01) |
| ***F04C 27/00*** | (2006.01) |
| ***F04C 28/24*** | (2006.01) |
| ***F04C 18/08*** | (2006.01) |
| ***F04C 29/00*** | (2006.01) |
| ***F04C 29/02*** | (2006.01) |
| ***F04C 18/16*** | (2006.01) |
| ***F04C 25/02*** | (2006.01) |
| ***F01C 1/12*** | (2006.01) |
| ***F01C 19/00*** | (2006.01) |
| ***F01C 1/08*** | (2006.01) |

(52) U.S. Cl.

CPC ..... *F04C 2/084* (2013.01); *F04C 15/0038* (2013.01); *F04C 18/084* (2013.01); *F04C 18/086* (2013.01); *F04C 18/16* (2013.01); *F04C 25/02* (2013.01); *F04C 27/00* (2013.01); *F04C 27/009* (2013.01); *F04C 28/24* (2013.01); *F04C 29/005* (2013.01); *F04C 29/02* (2013.01); *F04C 2240/30* (2013.01); *F04C 2240/40* (2013.01); *F04C 2240/60* (2013.01)

(56) References Cited

FOREIGN PATENT DOCUMENTS

| | | | |
|---|---|---|---|
| JP | 2007-024015 | A | 2/2007 |
| JP | 2009-144822 | A | 7/2009 |
| JP | 2010-144576 | A | 7/2010 |
| JP | 2014-173566 | A | 9/2014 |
| JP | 2019-178666 | A | 10/2019 |

* cited by examiner

ELECTRIC PUMP

1. FIELD

The present disclosure relates to an electric pump.

2. DESCRIPTION OF RELATED ART

Japanese Laid-Open Patent Publication No. 2010-144576 discloses an electric pump that includes a driving rotor and a driven rotor that are driven by the rotation of a driving shaft. The electric pump further includes a driving gear disposed on the driving shaft and a driven gear disposed on a driven shaft. The driving gear and the driven gear transmit the rotation of the driving shaft to the driven rotor so as to rotate the driven rotor. The electric pump further includes an electric motor that rotates the driving shaft and includes a housing. The housing includes a gear chamber, a rotor chamber, and a motor chamber. The gear chamber accommodates the driving gear and the driven gear. Further, the gear chamber encapsulates oil that is supplied to the driving gear and the driven gear. The rotor chamber accommodates the driving rotor and the driven rotor. The motor chamber accommodates the electric motor. The motor chamber, the gear chamber, the rotor chamber are arranged in order in a rotational axial direction of the driving shaft.

The housing includes a first partition wall that separates the gear chamber from the rotor chamber and a second partition wall that separates the gear chamber from the motor chamber. The first partition wall includes a first through-hole through which the driving shaft passes and a second through-hole through which the driven shaft passes. The second partition wall includes a third through-hole through which the driving shaft passes. The electric pump includes a first seal member arranged in the first through-hole to seal the space between the gear chamber and the rotor chamber, a second seal member arranged in the second through-hole to seal the space between the gear chamber and the rotor chamber, and a third seal member arranged in the third through-hole to seal the space between the gear chamber and the motor chamber.

While the electric pump is running, the fluid drawn into the rotor chamber may enter the gear chamber. When the pressure in the gear chamber increases, the oil in the gear chamber may leak into the rotor chamber. As the pressure in the gear chamber increases, the difference between the pressure in the gear chamber and the pressure in the motor chamber increases so as to increase a tensional force of the third seal member on the driving shaft. This causes wear to easily occur between the third seal member and the driving shaft and worsens the durability of the third seal member. As a result, the reliability of the electric pump may decrease.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An electric pump according to an aspect includes a driving shaft including a rotational axis, a driving rotor and a driven rotor that are driven by rotation of the driving shaft, a driven shaft configured to rotate the driven rotor, a driving gear disposed on the driving shaft, the driving gear being configured to transmit the rotation of the driving shaft, a driven gear disposed on the driven shaft, the driven gear being configured to transmit the rotation of the driving shaft, an electric motor configured to rotate the driving shaft, and a housing that includes a gear chamber, a rotor chamber, and a motor chamber, the gear chamber accommodating the driving gear and the driven gear and encapsulating oil supplied to the driving gear and the driven gear, the rotor chamber accommodating the driving rotor and the driven rotor, the motor chamber accommodating the electric motor. The motor chamber, the gear chamber, and the rotor chamber are arranged in order in a rotational axial direction of the driving shaft. The housing includes a first partition wall that separates the gear chamber from the rotor chamber and a second partition wall that separates the gear chamber from the motor chamber. The first partition wall includes a first through-hole through which the driving shaft passes and a second through-hole through which the driven shaft passes. The second partition wall includes a third through-hole through which the driving shaft passes. The electric pump further includes a first seal member arranged in the first through-hole to seal a space between the gear chamber and the rotor chamber, a second seal member arranged in the second through-hole to seal the space between the gear chamber and the rotor chamber, and a third seal member arranged in the third through-hole to seal a space between the gear chamber and the motor chamber. The third seal member seals the space between the gear chamber and the motor chamber to a lesser extent than the first seal member and the second seal member seal the space between the gear chamber and the rotor chamber.

Other aspects and advantages of the present invention will become apparent from the following description, taken in conjunction with the accompanying drawings, illustrating by way of example the principles of the invention.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described.

Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

An embodiment of an electric pump 10 will now be described with reference to FIGS. 1 to 6. The electric pump 10 of the present embodiment is installed in a fuel cell electric vehicle. The fuel cell electric vehicle includes a fuel cell electric system that generates power when supplied with oxygen and hydrogen. The electric pump is used as a hydrogen pump for the fuel cell electric vehicle that recirculates hydrogen gas (hydrogen off-gas) corresponding to fluid discharged out of fuel cells and supplies the hydrogen gas to the fuel cells again.

Figure 1:
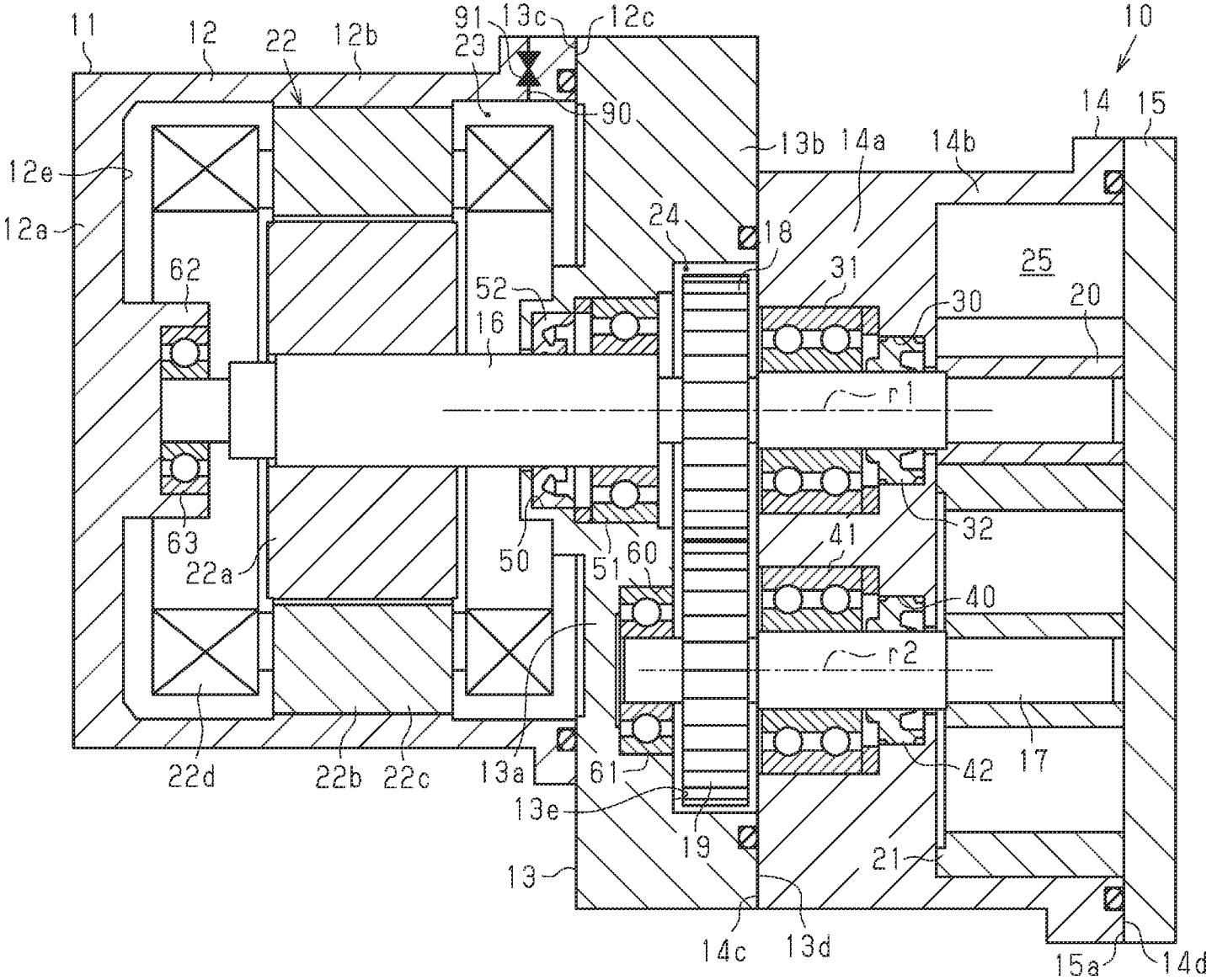
FIG. 1 is a cross-sectional plan view showing an embodiment of a fuel cell pump.

As shown in FIG. 1, a housing 11 of the electric pump 10 is tubular and includes a motor housing member 12, a gear housing member 13, a rotor housing member 14, and a cover member 15. The motor housing member 12 includes a flat end wall 12*a* and a tubular peripheral wall 12*b* extending from a peripheral portion of the end wall 12*a*. Thus, the motor housing member 12 has the shape of a tube having a closed end. The gear housing member 13 includes a flat end wall 13*a* and a tubular peripheral wall 13*b* extending from a peripheral portion of the end wall 13*a*. Thus, the gear housing member 13 has the shape of a tube having a closed end.

The gear housing member 13 is coupled to an open end of the peripheral wall 12*b* of the motor housing member 12 with an outer surface 13*c* of the end wall 13*a* of the gear housing member 13 in contact with an open end surface 12*c* of the peripheral wall 12*b* of the motor housing member 12. The end wall 13*a* of the gear housing member 13 closes the opening of the peripheral wall 12*b* of the motor housing member 12. The axial direction of the peripheral wall 12*b* of the motor housing member 12 and the axial direction of the peripheral wall 13*b* of the gear housing member 13 conform to each other.

The rotor housing member 14 includes a flat end wall 14*a* and a tubular peripheral wall 14*b* extending from a peripheral portion of the end wall 14*a*. Thus, the rotor housing member 14 has the shape of a tube having a closed end. The rotor housing member 14 is coupled to an open end of the peripheral wall 13*b* of the gear housing member 13 with an outer surface 14*c* of the end wall 14*a* of the rotor housing member 14 in contact with an open end surface 13*d* of the peripheral wall 13*b* of the gear housing member 13. The end wall 14*a* of the rotor housing member 14 closes the opening of the peripheral wall 13*b* of the gear housing member 13. The axial direction of the peripheral wall 13*b* of the gear housing member 13 and the axial direction of the peripheral wall 14*b* of the rotor housing member 14 conform to each other.

The cover member 15 is flat. The cover member 15 is coupled to an open end of the peripheral wall 14*b* of the rotor housing member 14 with an end surface 15*a* of the cover member 15 in contact with an open end surface 14*d* of the peripheral wall 14*b* of the rotor housing member 14. The cover member 15 closes the opening of the peripheral wall 14*b* of the rotor housing member 14.

The electric pump 10 includes a driving shaft 16 and a driven shaft 17 that are disposed parallel to each other and rotationally supported by the housing 11. Thus, the driven shaft 17 is disposed parallel to the driving shaft 16. The rotational axial direction of each of the driving shaft 16 and the driven shaft 17 conforms to the axial direction of each of the peripheral walls 12*b*, 13*b*, and 14*b*. The electric pump 10 further includes a disc-shaped driving gear 18 disposed on the driving shaft 16 and a disc-shaped driven gear 19 disposed on the driven shaft 17. The driven gear 19 meshes with the driving gear 18 and rotates with the driving gear 18. The electric pump 10 includes a driving rotor 20 that is rotated by the driving gear 18 and a driven rotor 21 that is rotated by the driven gear 19. The driving rotor 20 is disposed at a first end of the driving shaft 16. The driven rotor 21 is disposed at a first end of the driven shaft 17. The driven rotor 21 rotates together with the driving rotor 20. The driving rotor 20 and the driven rotor 21 are driven by the rotation of the driving shaft 16. The driving gear 18 and the driven gear 19 transmit the rotation of the driving shaft 16 to the driven shaft 17, which rotates the driven rotor 21.

The electric pump 10 includes an electric motor 22 that rotates the driving shaft 16. Thus, the electric motor 22 is a drive source that is driven in order to rotate the driving shaft 16. The housing 11 includes a motor chamber 23 that accommodates the electric motor 22. The motor chamber 23 is defined by the end wall 12*a* of the motor housing member 12, the peripheral wall 12*b* of the motor housing member 12, and the end wall 13*a* of the gear housing member 13.

The electric motor 22 includes a motor rotor 22*a* and a stator 22*b*. The motor rotor 22*a* is fixed to the driving shaft 16 to rotate integrally with the driving shaft 16. The stator 22*b* includes a tubular stator core 22*c* that is fixed to an inner surface of the peripheral wall 12*b* of the motor housing member 12. The stator core 22*c* extends around the motor rotor 22*a*. The stator 22*b* includes a coil 22*d* wound around the stator core 22*c*. When power is supplied to the coil 22*d*, the motor 22 is driven to rotate the motor rotor 22*a* integrally with the driving shaft 16.

A gear chamber 24 is arranged in the housing 11 to accommodate the driving gear 18 and the driven gear 19. The gear chamber 24 is defined by the end wall 13*a* of the gear housing member 13, the peripheral wall 13*b* of the gear housing member 13, and the end wall 14*a* of the rotor housing member 14. The driving gear 18 and the driven gear 19 mesh with each other and are accommodated in the gear chamber 24. The gear chamber 24 encapsulates oil that is supplied to the driving gear 18 and the driven gear 19. The oil lubricates the driving gear 18 and the driven gear 19 and limits increases in the temperature of the driving gear 18 and the driven gear 19. The driving gear 18 and the driven gear 19, which are immersed in the oil, can rotate at a relatively high speed without resulting in galling or wear.

The housing 11 includes a rotor chamber 25 that accommodates the driving rotor 20 and the driven rotor 21. Accordingly, the housing 11 includes the gear chamber 24, the rotor chamber 25, and the motor chamber 23. The rotor chamber 25 is defined by the end wall 14*a* of the rotor housing member 14, the peripheral wall 14*b* of the rotor housing member 14, and the cover member 15. In the present embodiment, the motor chamber 23, the gear chamber 24, and the rotor chamber 25 are arranged in order in the rotational axial direction of the driving shaft 16.

The end wall 14*a* of the rotor housing member 14 separates the gear chamber 24 from the rotor chamber 25 in the rotational axial direction of the driving shaft 16. Thus, the end wall 14*a* of the rotor housing member 14 is a first partition wall that separates the gear chamber 24 from the rotor chamber 25. The end wall 13*a* of the gear housing member 13 separates the gear chamber 24 from the motor chamber 23 in the rotational axial direction of the driving shaft 16. Thus, the end wall 13*a* of the gear housing member 13 is a second partition wall that separates the gear chamber 24 from the motor chamber 23. The cover member 15 separates the rotor chamber 25 from the outside of the housing 11 in the rotational axial direction of the driving shaft 16.

The end wall 14*a* of the rotor housing member 14 includes a first through-hole 30 through which the driving shaft 16 passes. The first through-hole 30 includes a first end that opens in the rotor chamber 25. The first through-hole 30 includes a second end that opens in the gear chamber 24. The first through-hole 30 includes a first bearing 31 that rotationally supports the driving shaft 16. The first through-hole 30 further includes a first seal member 32. The first seal member 32 is closer to the rotor chamber 25 than to the first bearing 31 of the first through-hole 30. The first seal member 32 seals the space between the first through-hole 30 and the driving shaft 16. Thus, the first seal member 32 seals the space between the gear chamber 24 and the rotor chamber 25.

The end wall 14*a* of the rotor housing member 14 includes a second through-hole 40 through which the driven shaft 17 passes. The second through-hole 40 includes a first end that opens in the rotor chamber 25. The second through-hole 40 includes a second end that opens in the gear chamber 24. The second through-hole 40 includes a second bearing 41 that rotationally supports the driven shaft 17. The second through-hole 40 further includes a second seal member 42. The second seal member 42 is closer to the rotor chamber 25 than to the second bearing 41 of the second through-hole 40. The second seal member 42 seals the space between the second through-hole 40 and the driven shaft 17. Thus, the second seal member 42 seals the space between the gear chamber 24 and the rotor chamber 25.

The end wall 13*a* of the gear housing member 13 includes a third through-hole 50 through which the driving shaft 16 passes. The third through-hole 50 includes a first end that opens in the gear chamber 24. The third through-hole 50 includes a second end that opens in the motor chamber 23. The third through-hole 50 includes a third bearing 51 that rotationally supports the driving shaft 16. The third through-hole 50 further includes a third seal member 52. The third seal member 52 is closer to the motor chamber 23 than to the third bearing 51 of the third through-hole 50. The third seal member 52 seals the space between the third through-hole 50 and the driving shaft 16. Thus, the third seal member 52 seals the space between the gear chamber 24 and the motor chamber 23.

The driving shaft 16 extends through the end wall 13*a* of the gear housing member 13 and the end wall 14*a* of the rotor housing member 14. The driven shaft 17 extends through the end wall 14*a* of the rotor housing member 14. Thus, the driving shaft 16 and the driven shaft 17 extend through the end wall 14*a* of the rotor housing member 14. The portion of the driving shaft 16 extending through the third through-hole 50 has a larger outer diameter than the portion of the driving shaft 16 extending through the first through-hole 30. The portion of the driving shaft 16 extending through the first through-hole 30 has the same outer diameter as the portion of the driven shaft 17 extending through the second through-hole 40.

The end wall 13*a* of the gear housing member 13 has an inner surface 13*e* including a bearing accommodation recess 60. The bearing accommodation recess 60 includes a fourth bearing 61 that rotationally supports the second end of the driven shaft 17. The first end of the driven shaft 17 passes through the second through-hole 40 and protrudes into the rotor chamber 25. The second end of the driven shaft 17 is disposed in the bearing accommodation recess 60 and rotationally supported by the fourth bearing 61. Thus, the driven shaft 17 is supported by the housing 11 in a cantilevered manner.

The end wall 12*a* of the motor housing member 12 has an inner surface 12*e* including a tubular bearing portion 62. The bearing portion 62 includes a fifth bearing 63 that rotationally supports the end of the driving shaft 16 on a side opposite from the rotor chamber 25. The first end of the driving shaft 16 passes through the first through-hole 30 and protrudes into the rotor chamber 25. The second end of the driving shaft 16 is disposed in the bearing portion 62 and rotationally supported by the fifth bearing 63. Thus, the driving shaft 16 is supported by the housing 11 in a cantilevered manner.

Figure 2:
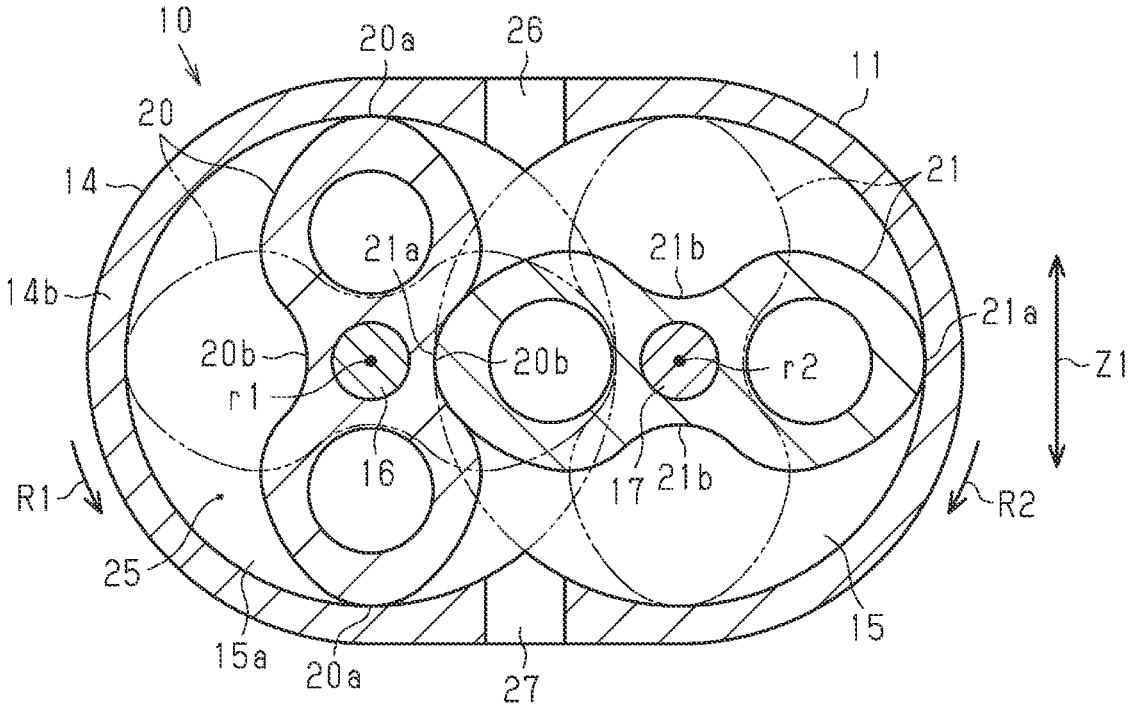
FIG. 2 is a vertical cross-sectional view of the electric pump.

As shown in FIG. 2, each of the driving rotor 20 and the driven rotor 21 is shaped as a numeral '8' (hourglass-shaped) in a cross-sectional view that is orthogonal to the rotational axial directions of the driving shaft 16 and the driven shaft 17. The driving rotor 20 includes two lobes 20*a* and recesses 20*b* located between the two lobes 20*a*. The driven rotor 21 includes two lobes 21*a* and recesses 21*b* located between the two lobes 21*a*.

The driving rotor 20 and the driven rotor 21 are rotatable in the rotor chamber 25 while repeating engagement of the lobes 20*a* of the driving rotor 20 with the recesses 21*b* of the driven rotor 21 and engagement of the recesses 20*b* of the driving rotor 20 with the lobes 21*a* of the driven rotor 21. The driving rotor 20 and the driven rotor 21 rotate in the directions opposite from each other in the rotor chamber 25. More specifically, the driving rotor 20 rotates in arrow R1 direction shown in FIG. 2. The driven rotor 21 rotates in arrow R2 direction shown in FIG. 2.

The rotor housing member 14 includes an intake port 26 that draws hydrogen gas into the rotor chamber 25 and a discharge port 27 that discharges hydrogen gas out of the rotor chamber 25. The intake port 26 and the discharge port 27 are located on opposite sides of the rotor chamber 25 on the outer surface of the peripheral wall 14*b* of the rotor housing member 14. The intake port 26 and the discharge port 27 connect the rotor chamber 25 to the outside of the rotor housing member 14. A linear direction Z1 connecting the intake port 26 to the discharge port 27 perpendicularly intersects rotational axes r1, r2 of the driving shaft 16 and the driven shaft 17. In FIG. 2, the linear direction Z1 conforms to the gravitational direction.

Figure 3:
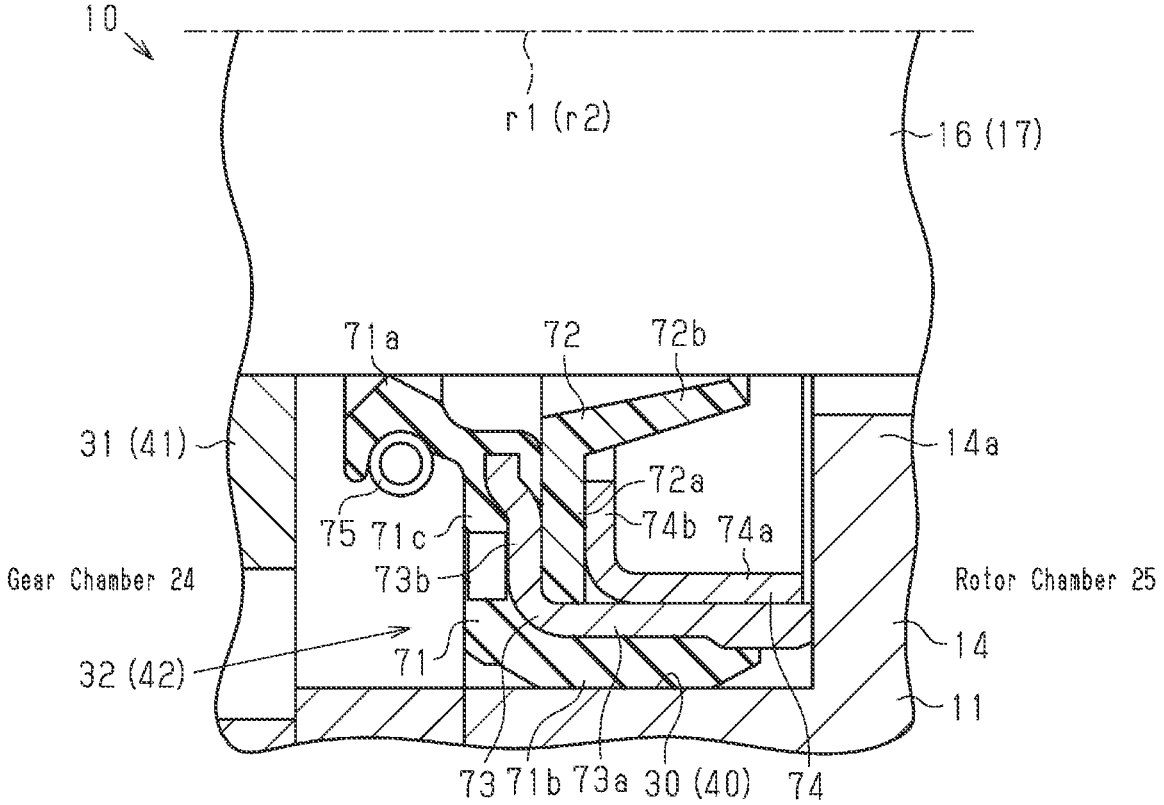
FIG. 3 is a cross-sectional view showing the relationship between the first seal member and the driving shaft.

FIG. 3 shows the relationship between the driving shaft 16, the first through-hole 30, and the first seal member 32. The relationship between the driven shaft 17, the second through-hole 40, and the second seal member 42 are the same as the relationship between the driving shaft 16, the first through-hole 30, and the first seal member 32 and thus will not be described in detail. Further, the first seal member 32 and the second seal member 42 have the same structure. Thus, in FIG. 3, the structure of the first seal member 32 will be described in detail and the structure of the second seal member 42 will not be described in detail.

As shown in FIG. 3, the first seal member 32 includes a seal body 71, a lip member 72, a reinforcement ring 73, and a holding member 74. The seal body 71 is tubular. The seal body 71 is made of rubber. The seal body 71 includes a main lip portion 71*a*, an outer seal portion 71*b*, and a seal connection portion 71*c*. The main lip portion 71*a*, the outer seal portion 71*b*, and the seal connection portion 71*c* are arranged from the inner side toward the outer side of the seal body 71 in the order of the main lip portion 71*a*, the seal connection portion 71*c*, and the outer seal portion 71*b*.

The outer seal portion 71*b* is tubular. The outer seal portion 71*b* extends along the wall surface of the first through-hole 30. The outer surface of the outer seal portion 71*b* is in close contact with the wall surface of the first through-hole 30. The seal connection portion 71*c* has an annular shape extending from an inner portion of the outer seal portion 71*b* toward the inner side of the seal body 71 in the radial direction. More specifically, the seal connection portion 71*c* extends toward the inner side of the seal body 71 in the radial direction from the end of the inner portion of the outer seal portion 71*b* closer to the gear chamber 24. The main lip portion 71*a*, which is tubular, extends and protrudes from the inner edge of the seal connection portion 71*c* toward the inner side of the seal body 71 in the radial direction. The direction in which the main lip portion 71*a* extends from the seal connection portion 71*c* is opposite from the direction in which the outer seal portion 71*b* extends from the seal connection portion 71*c*. An annular garter spring 75 is attached to the outer portion of the main lip portion 71*a*. The garter spring 75 limits the separation of the main lip portion 71*a* from the outer surface of the driving shaft 16 and brings the main lip portion 71*a* into close contact with the outer surface of the driving shaft 16. The close contact of the outer seal portion 71*b* with the wall surface of the first through-hole 30 and the close contact of the main lip portion 71*a* with the outer surface of the driving shaft 16 cause the first seal member 32 to seal the space between the outer surface of the driving shaft 16 and the wall surface of the first through-hole 30.

The reinforcement ring 73 is made of metal. The reinforcement ring 73 is held by the seal body 71. The reinforcement ring 73 includes an extension 73*a* and a flange portion 73*b*. The extension 73*a* has a tubular shape extending along the inner surface of the outer seal portion 71*b*. The flange portion 73*b* has an annular shape extending along the seal connection portion 71*c*. The flange portion 73*b* extends in a direction that is orthogonal to the axial direction of the extension 73*a*. The flange portion 73*b* extends from the inner surface of the extension 73*a*.

The lip member 72 is made of polytetrafluoroethylene (PTFE). The lip member 72 includes a held portion 72*a* and a dust lip portion 72*b*. The held portion 72*a* has an annular shape extending along the flange portion 73*b* of the reinforcement ring 73. The dust lip portion 72*b* has the shape of a conical tube protruding from the inner edge of the held portion 72*a*. The dust lip portion 72*b* extends so as to gradually become farther from the main lip portion 71*a* as the dust lip portion 72*b* becomes farther from the inner edge of the held portion 72*a*. The dust lip portion 72*b* extends from the held portion 72*a* toward the outer surface of the driving shaft 16. The dust lip portion 72*b* prevents the entry of foreign matter from the rotor chamber 25 to the gear chamber 24.

The holding member 74 is made of metal. The holding member 74 includes a first holding portion 74*a* and a second holding portion 74*b*. The first holding portion 74*a* has a tubular shape extending along the inner surface of the extension 73*a* of the reinforcement ring 73. The first holding portion 74*a* holds the extension 73*a* of the reinforcement ring 73 so as to press the extension 73*a* against the outer seal portion 71*b*. The second holding portion 74*b* has an annular shape extending along the held portion 72*a* of the lip member 72. The second holding portion 74*b* holds the held portion 72*a* of the lip member 72 and the flange portion 73*b* of the reinforcement ring 73 so as to press the held portion 72*a* and the flange portion 73*b* against the seal connection portion 71*c*. Thus, the seal body 71, the lip member 72, the reinforcement ring 73, and the holding member 74 are integrated with each other.

Figure 4:
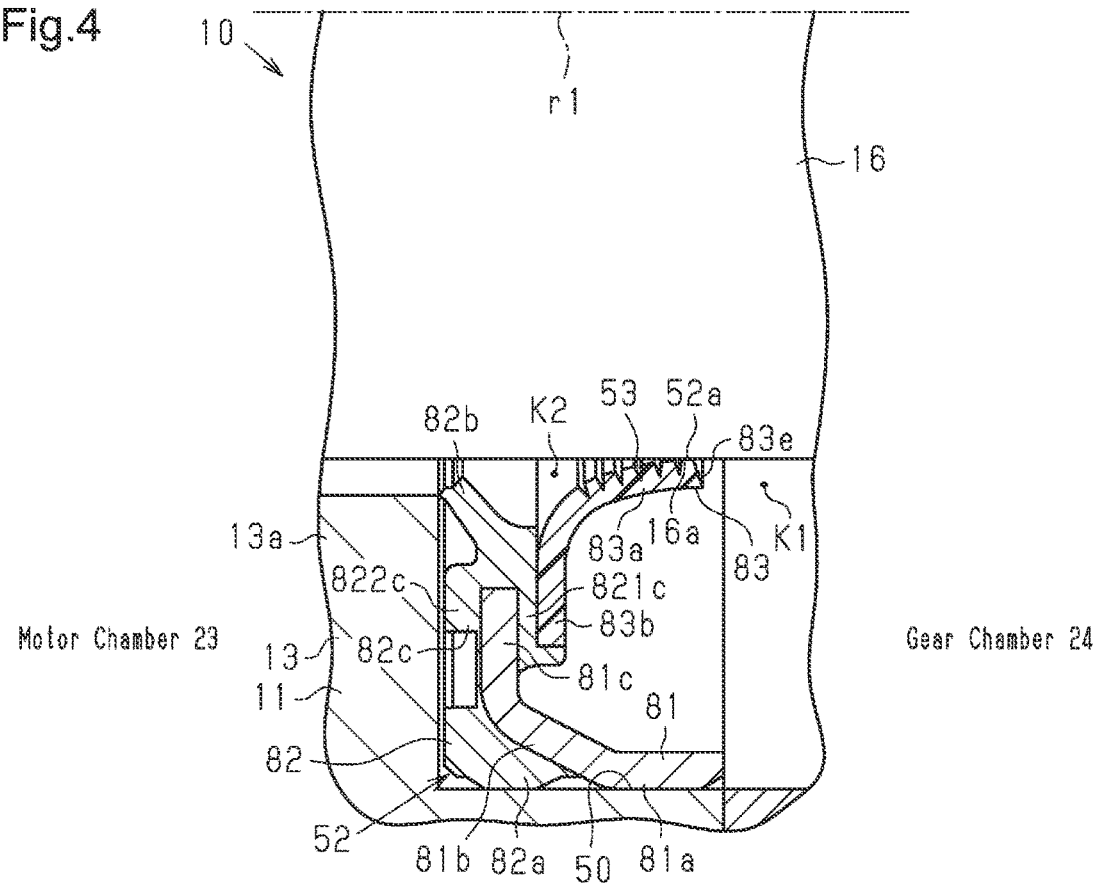
FIG. 4 is a cross-sectional view showing the relationship between the third seal member and the driving shaft.

As shown in FIG. 4, the third seal member 52 includes an attachment ring 81, a rubber member 82, and a main lip member 83. The attachment ring 81 is made of metal. The attachment ring 81 includes a tubular portion 81*a*, a coupling portion 81*b*, and a flange portion 81*c*. The flange portion 81*c* has an annular shape extending in a direction that is orthogonal to the axial direction of the tubular portion 81*a*. The flange portion 81*c* extends toward the inner side of the tubular portion 81*a* in the radial direction of the tubular portion 81*a*. The coupling portion 81*b* has the shape of a conical tube that couples the tubular portion 81*a* to the flange portion 81*c*. The coupling portion 81*b* is continuous with an edge of the tubular portion 81*a* in the axial direction, that is, a first edge of the tubular portion 81*a*. The coupling portion 81*b* gradually extends toward the inner side of the tubular portion 81*a* in the radial direction as the coupling portion 81*b* becomes farther from the first edge of the tubular portion 81*a*. The coupling portion 81*b* extends obliquely with respect to the axial direction of the tubular portion 81*a*.

The rubber member 82 is annular. The rubber member 82 includes an outer seal portion 82*a*, a dust lip portion 82*b*, and a seal connection portion 82*c*. The outer seal portion 82*a*, the dust lip portion 82*b*, and the seal connection portion 82*c* are arranged from the inner side toward the outer side of the rubber member 82 in the order of the dust lip portion 82*b*, the seal connection portion 82*c*, and the outer seal portion 82*a*.

The outer seal portion 82*a* is tubular. The outer seal portion 82*a* extends along an outer surface of the coupling portion 81*b* of the attachment ring 81. The outer seal portion 82*a* is in close contact with the outer surface of the coupling portion 81*b* of the attachment ring 81. Further, the outer surface of the outer seal portion 82*a* is in close contact with the wall surface of the third through-hole 50. Thus, the outer seal portion 82*a* seals the space between the attachment ring 81 and the gear housing member 13.

The seal connection portion 82*c* has an annular shape extending from an inner portion of the outer seal portion 82*a* toward the inner side of the rubber member 82 in the radial direction. The seal connection portion 82*c* extends along the flange portion 81*c* of the attachment ring 81. The seal connection portion 82*c* includes a first close contact portion 821*c* that is in close contact with a surface of the flange portion 81*c* closer to the tubular portion 81*a* and a second close contact portion 822*c* that is in close contact with a surface of the flange portion 81*c* opposite from the tubular portion 81*a*. The seal connection portion 82*c* holds the flange portion 81*c* with the first close contact portion 821*c* and the second close contact portion 822*c* in close contact with the flange portion 81*c* of the attachment ring 81. Thus, the attachment ring 81 is integrated with the rubber member 82.

The dust lip portion 82*b* has the shape of a conical tube protruding from the inner edge of the seal connection portion 82*c* toward the inner side of the rubber member 82 in the radial direction. The dust lip portion 82*b* extends so as to gradually become farther from the first close contact portion 821*c* as the dust lip portion 82*b* becomes farther from the inner edge of the seal connection portion 82*c*. The dust lip portion 82*b* extends from the seal connection portion 82*c* toward the outer surface of the driving shaft 16. The dust lip portion 82*b* prevents the entry of foreign matter from the motor chamber 23 to the gear chamber 24.

The main lip member 83 is tubular. The main lip member 83 is made of polytetrafluoroethylene (PTFE). The main lip member 83 includes an inner seal portion 83*a* and a held portion 83*b*. The inner seal portion 83*a* has the shape of a conical tube. The held portion 83*b* has an annular shape extending in a direction that is orthogonal to the axial direction of the inner seal portion 83*a*. The held portion 83*b* extends in parallel to the flange portion 81*c* of the attachment ring 81. The held portion 83*b* is in close contact with a part of the first close contact portion 821*c* of the seal connection portion 82*c* on the side opposite from the flange portion 81*c*. The first close contact portion 821*c* holds the main lip member 83 with the held portion 83*b* in close contact with the first close contact portion 821*c* of the seal connection portion 82*c* so that the main lip member 83 is attached to the rubber member 82. Thus, the main lip member 83 is integrated with the rubber member 82, and the main lip member 83 is integrated with the attachment ring 81 by the rubber member 82.

The inner seal portion 83*a* extends so as to gradually become farther from the dust lip portion 82*b* as the inner seal portion 83*a* becomes farther from the inner edge of the held portion 83*b*. The axial direction of the inner seal portion 83*a* conforms to the axial direction of the tubular portion 81*a* of the attachment ring 81. The inner seal portion 83*a* gradually becomes closer to the outer surface of the driving shaft 16 as the inner seal portion 83*a* becomes farther from the inner edge of the held portion 83*b*. The portion of the inner surface of the inner seal portion 83*a* at the distal end of the inner seal portion 83*a* is in close contact with the outer surface of the driving shaft 16. The inner surface of the inner seal portion 83*a* includes a portion that is in close contact with the outer surface of the driving shaft 16 and a portion that is separated from the outer surface of the driving shaft 16. Thus, the portion of the inner surface of the inner seal portion 83*a* in close contact with the outer surface of the driving shaft 16 is a seal surface 52*a* of the third seal member 52 adjacent to the driving shaft 16. The portion of the outer surface of the driving shaft 16 that slides on the seal surface 52*a* is a sliding surface 16*a* of the driving shaft 16 adjacent to the third seal member 52.

The third seal member 52 is fixed to the end wall 13*a* of the gear housing member 13 on the inner side of the third through-hole 50 by press-fitting the tubular portion 81*a* of the attachment ring 81 into the third through-hole 50. In a state where the third seal member 52 is fitted to the end wall 13*a* of the gear housing member 13 on the inner side of the third through-hole 50, the gear chamber 24 is connected to a first space K1 that is closer to the gear chamber 24 than the seal surface 52*a* of the third seal member 52 on the inner side of the third through-hole 50. Thus, in the state where the third seal member 52 is fitted to the end wall 13*a* of the gear housing member 13 on the inner side of the third through-hole 50, a distal edge 83*e* of the inner seal portion 83*a* faces the gear chamber 24. In the state where the third seal member 52 is fitted to the end wall 13*a* of the gear housing member 13 on the inner side of the third through-hole 50, the motor chamber 23 is connected to a second space K2 that is closer to the motor chamber 23 than the seal surface 52*a* of the third seal member 52 on the inner side of the third through-hole 50. Thus, the portion of the inner surface of the inner seal portion 83*a* separated from the outer surface of the driving shaft 16 faces the motor chamber 23.

Figure 5:
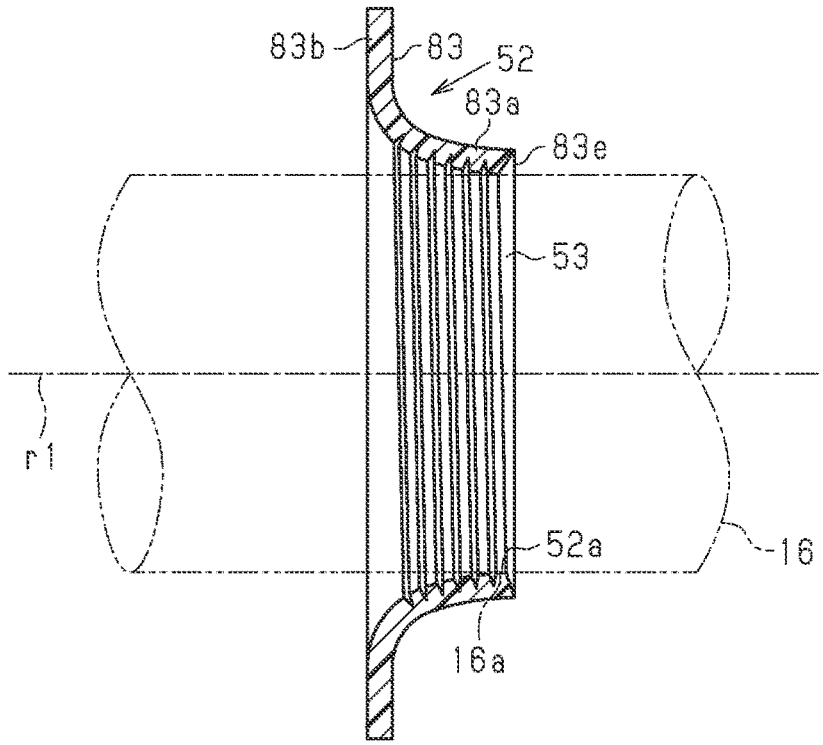
FIG. 5 is a cross-sectional view showing the relationship between the main lip member of the third seal member and the driving shaft.

As shown in FIGS. 4 and 5, the third seal member 52 includes a first helical groove 53. The first helical groove 53 is arranged in the inner surface of the inner seal portion 83*a*. The first helical groove 53 includes a first end that opens in the distal edge 83*e* of the inner seal portion 83*a*. The first helical groove 53 includes a second end that extends beyond the seal surface 52*a* to the portion of the inner surface of the inner seal portion 83*a* separated from the outer surface of the driving shaft 16. Thus, the seal surface 52*a* of the third seal member 52 includes the first helical groove 53. The first helical groove 53 extends beyond the seal surface 52*a* from the distal edge 83*e* of the inner seal portion 83*a* and is continuous with the portion of the inner surface of the inner seal portion 83*a* separated from the outer surface of the driving shaft 16. Thus, the first helical groove 53 connects the inside of the gear chamber 24 to the inside of the motor chamber 23.

Figure 6:
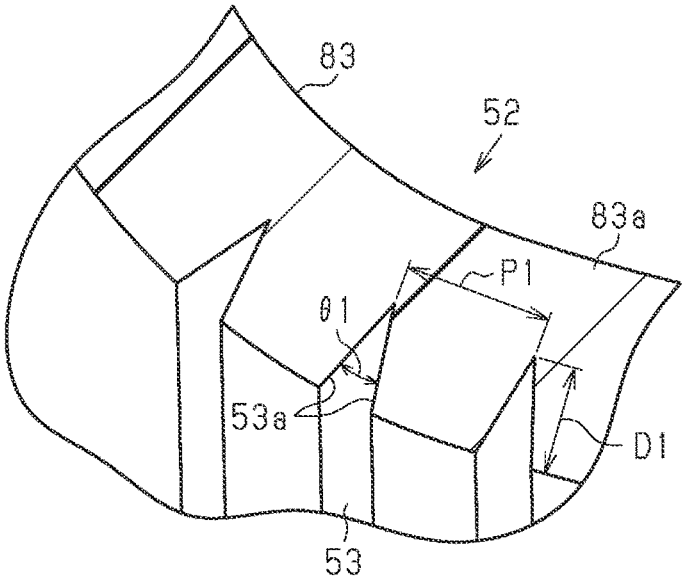
FIG. 6 is an enlarged cross-sectional view showing a portion of the first helical groove.

As shown in FIG. 6, the first helical groove 53 has a triangular cross-section. In other words, the first helical groove 53 has a V-shaped cross-section. The first helical groove 53 includes two obliquely-extending groove inner surfaces 53*a* that intersect the inner surface of the inner seal portion 83*a*. The edges of the groove inner surfaces 53*a* located on the side opposite from the inner surface of the inner seal portion 83*a* intersect with each other. The intersection point of the two groove inner surfaces 53*a* is the lowermost part of the first helical groove 53. Angle θ1 formed by the groove inner surfaces 53*a* is, for example, 20 degrees. The first helical groove 53 has a fixed pitch P1. The first helical groove 53 has depth D1 that is fixed from the first end to the second end of the first helical groove 53. Pitch P1 of the first helical groove 53 is greater than depth D1 of the first helical groove 53.

As shown in FIG. 1, the motor housing member 12 includes a discharge passage 90. One end of the discharge passage 90 is connected to the inside of the motor chamber 23. The other end of the discharge passage 90 is connected to the outside of the motor housing member 12. Thus, the discharge passage 90 connects the inside of the motor chamber 23 to the outside of the motor housing member 12. The discharge passage 90 includes a valve member 91. The valve member 91 is configured to open when the pressure in the motor chamber 23 becomes greater than a specific pressure. The valve member 91 is configured to discharge the fluid from the inside of the motor chamber 23 to the outside of the motor housing member 12 when the valve member 91 opens. Thus, the valve member 91 discharges fluid from the inside of the motor chamber 23 to the outside of the motor housing member 12.

The operation of the present embodiment will now be described.

When the electric pump 10 starts running and the electric motor 22 is driven to rotate the driving shaft 16, the coupling of the driving gear 18 and the driven gear 19 that mesh with each other causes the driven shaft 17 to rotate in the direction opposite from the rotation direction of the driving shaft 16. This rotates the driving rotor 20 and the driven rotor 21 in the opposite directions. The rotation of the driving rotor 20 and the driven rotor 21 causes the electric pump 10 to draw hydrogen gas into the rotor chamber 25 through the intake port 26 and discharge hydrogen gas out of the rotor chamber 25 through the discharge port 27.

While the electric pump 10 is running, the fluid drawn into the rotor chamber 25 may enter the gear chamber 24. For example, when the electric pump 10 starts running, the pressure in the rotor chamber 25 is greater than the pressure in the gear chamber 24 and thus the hydrogen gas drawn into the rotor chamber 25 enters the gear chamber 24. As a result, the pressure in the gear chamber 24 gradually increases.

The first helical groove 53 connects the inside of the gear chamber 24 to the inside of the motor chamber 23. Thus, the third seal member 52 seals the space between the gear chamber 24 and the motor chamber 23 to a lesser extent than the first seal member 32 and the second seal member 42 seal the space between the gear chamber 24 and the rotor chamber 25. When the pressure in the gear chamber 24 increases, the fluid containing hydrogen gas (the fluid in the gear chamber 24) passes through the first helical groove 53 and is discharged into the motor chamber 23. Thus, when the pressure in the gear chamber 24 increases, the fluid in the gear chamber 24 leaks into the motor chamber 23 more easily than into the rotor chamber 25. When the fluid in the gear chamber 24 passes through the first helical groove 53 and is discharged into the motor chamber 23, increases in the pressure in the gear chamber 24 are limited. When the pressure in the motor chamber 23 becomes greater than the specific pressure, the fluid leaked from the gear chamber 24 into the motor chamber 23 is discharged by the valve member 91 to the outside of the motor housing member 12 through the discharge passage 90.

The above-described embodiment provides the following advantages.

(1) The third seal member 52 seals the space between the gear chamber 24 and the motor chamber 23 to a lesser extent than the first seal member 32 and the second seal member 42 seal the space between the gear chamber 24 and the rotor chamber 25. Thus, when the pressure in the gear chamber 24 increases, the fluid in the gear chamber 24 leaks into the motor chamber 23 more easily than into the rotor chamber 25. When the fluid in the gear chamber 24 leaks into the motor chamber 23, increases in the pressure in the gear chamber 24 are limited. This lowers the difference between the pressure in the gear chamber 24 and the pressure in the motor chamber 23 and prevents increases in a tensional force of the third seal member 52 on the driving shaft 16. As a result, the occurrence of wear between the third seal member 52 and the driving shaft 16 is limited. Thus, the durability of the third seal member 52 improves. Further, since increases in the pressure in the gear chamber 24 are limited, the oil in the gear chamber 24 is prevented from leaking into the rotor chamber 25. Such a structure improves the reliability of the electric pump 10 while preventing the oil in the gear chamber 24 from leaking into the rotor chamber 25.

(2) The first helical groove 53 connects the inside of the gear chamber 24 to the inside of the motor chamber 23. Thus, the third seal member 52 seals the space between the gear chamber 24 and the motor chamber 23 to a lesser extent than the first seal member 32 and the second seal member 42 seal the space between the gear chamber 24 and the rotor chamber 25. When the pressure in the gear chamber 24 increases, the fluid in the gear chamber 24 passes through the first helical groove 53 and is discharged into the motor chamber 23. As a result, when the fluid in the gear chamber 24 passes through the first helical groove 53 and is discharged into the motor chamber 23, increases in the pressure in the gear chamber 24 are limited.

(3) The first helical groove 53 has a triangular cross-section. The first helical groove 53, which has a triangular cross-section, is arranged in the seal surface 52*a* of the third seal member 52 adjacent to the driving shaft 16. When the pressure in the gear chamber 24 increases, the first helical groove 53 causes the fluid in the gear chamber 24 to be discharged into the motor chamber 23 in a favorable manner.

(4) The motor housing member 12 includes the discharge passage 90 that connects the inside of the motor chamber 23 to the outside of the motor housing member 12. The discharge passage 90 includes the valve member 91 that discharges the fluid from the inside of the motor chamber 23 to the outside of the motor housing member 12. Thus, the fluid leaked from the gear chamber 24 into the motor chamber 23 is discharged by the valve member 91 to the outside of the motor housing member 12 through the discharge passage 90.

(5) The portion of the driving shaft 16 extending through the third through-hole 50 has a larger outer diameter than the portion of the driving shaft 16 extending through the first through-hole 30. The portion of the driving shaft 16 extending through the first through-hole 30 has the same diameter as the portion of the driven shaft 17 extending through the second through-hole 40. In this structure, as compare with when, for example, the portion of the driving shaft 16 extending through the third through-hole 50 has a smaller outer diameter than the portion of the driving shaft 16 extending through the first through-hole 30, the portion of the third seal member 52 in contact with the driving shaft 16 is long in the circumferential direction. As the portion of the third seal member 52 in contact with the driving shaft 16 in the circumferential direction becomes longer, the fluid in the gear chamber 24 leaks into the motor chamber 23 more easily. Thus, when the pressure in the gear chamber 24 increases, the fluid in the gear chamber 24 leaks into the motor chamber 23 more easily than into the rotor chamber 25. This limits increases in the pressure in the gear chamber 24.

The above-described embodiment may be modified as follows. The above-described embodiment and the following modifications can be combined as long as the combined modifications remain technically consistent with each other.

Figure 7:
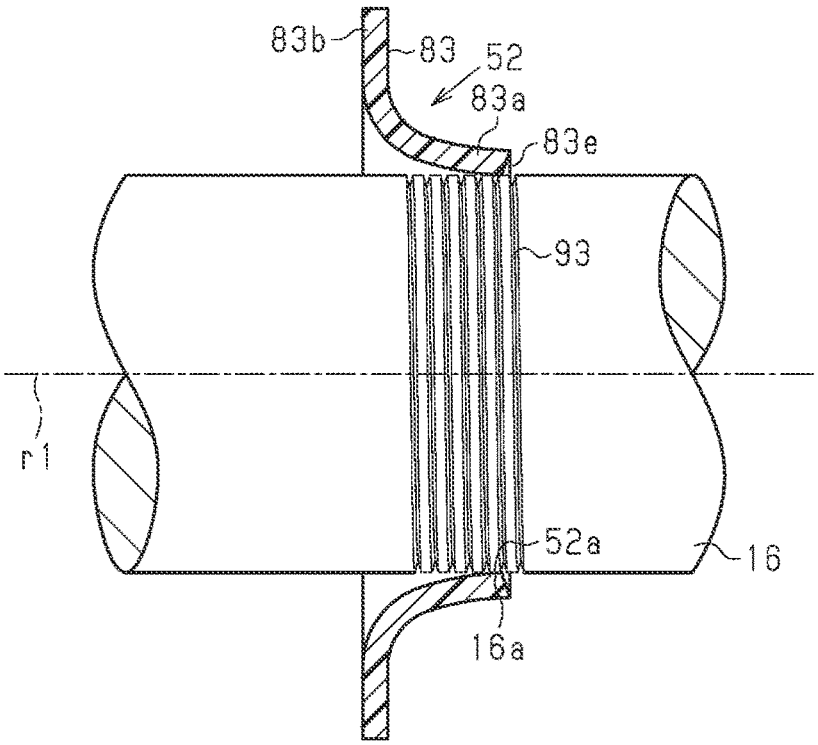
FIG. 7 is a cross-sectional view showing the relationship between the main lip member of the third seal member and the driving shaft in another embodiment.

As shown in FIG. 7, the third seal member 52 does not have to include the first helical groove 53. Instead, the outer surface of the driving shaft 16 may include a second helical groove 93. The second helical groove 93 includes a first end that opens in the outer surface of the driving shaft 16 at a portion that is slightly closer to the gear chamber 24 than to a portion opposing the distal edge 83*e* of the inner seal portion 83*a*. The second end of the second helical groove 93 extends beyond the sliding surface 16*a* to a portion opposing the portion of the inner surface of the inner seal portion 83*a* separated from the outer surface of the driving shaft 16. Thus, the sliding surface 16*a* of the driving shaft 16 adjacent to the third seal member 52 includes the second helical groove 93. The second helical groove 93 connects the inside of the gear chamber 24 to the inside of the motor chamber 23. The second helical groove 93 has a triangular cross-section. In other words, the second helical groove 93 has a V-shaped cross-section.

In this structure, since the second helical groove 93 connects the inside of the gear chamber 24 to the inside of the motor chamber 23, the third seal member 52 seals the space between the gear chamber 24 and the motor chamber 23 to a lesser extent than the first seal member 32 and the second seal member 42 seal the space between the gear chamber 24 and the rotor chamber 25. When the pressure in the gear chamber 24 increases, the fluid in the gear chamber 24 passes through the second helical groove 93 and is discharged into the motor chamber 23. Thus, when the pressure in the gear chamber 24 increases, the fluid in the gear chamber 24 leaks into the motor chamber 23 more easily than into the rotor chamber 25. As a result, when the fluid in the gear chamber 24 passes through the second helical groove 93 and is discharged into the motor chamber 23, increases in the pressure in the gear chamber 24 are limited. The second helical groove 93, which has a triangular cross-section, is arranged in the sliding surface 16*a* of the driving shaft 16 adjacent to the third seal member 52. When the pressure in the gear chamber 24 increases, the second helical groove 93 causes the fluid in the gear chamber 24 to be discharged into the motor chamber 23 in a favorable manner.

In the embodiment shown in FIG. 7, the third seal member 52 may include the first helical groove 53. In short, while the third seal member 52 includes the first helical groove 53, the outer surface of the driving shaft 16 may also include the second helical groove 93.

In the embodiment, the first seal member 32, the second seal member 42, and the third seal member 52 may be arranged such that the area of the third seal member 52 in contact with the third through-hole 50 is smaller than the area of the first seal member 32 in contact with the first through-hole 30 and the area of the second seal member 42 in contact with the second through-hole 40.

This structure allows the third seal member 52 to seal the space between the gear chamber 24 and the motor chamber 23 to a lesser extent than the first seal member 32 and the second seal member 42 seal the space between the gear chamber 24 and the rotor chamber 25. Accordingly, in this structure, for example, the third seal member 52 does not have to include the first helical groove 53.

In the embodiment, the first seal member 32, the second seal member 42, and the third seal member 52 may be arranged such that the area of the third seal member 52 projected on the third through-hole 50 in the rotational axial direction of the driving shaft 16 is larger than the area of the first seal member 32 projected on the first through-hole 30 in the rotational axial direction of the driving shaft 16 and the area of the second seal member 42 projected on the second through-hole 40 in the rotational axial direction of the driving shaft 16 and the third seal member 52 has a smaller thickness than the first seal member 32 and the second seal member 42.

For example, the area of the third seal member 52 projected on the third through-hole 50 in the rotational axial direction of the driving shaft 16 is obtained by subtracting, from the area with the radius from the rotational axis r1 of the driving shaft 16 to the outer surface of the outer seal portion 82*a*, the area with the radius from the rotational axis r1 of the driving shaft 16 to the seal surface 52*a*. The area of the first seal member 32 projected on the first through-hole 30 in the rotational axial direction of the driving shaft 16 is obtained by subtracting, from the area with the radius from the rotational axis r1 of the driving shaft 16 to the outer surface of the outer seal portion 71*b*, the area with the radius from the rotational axis r1 of the driving shaft 16 to the main lip portion 71*a*. The area of the second seal member 42 projected on the second through-hole 40 in the rotational axial direction of the driving shaft 16 is obtained by subtracting, from the area with the radius from the rotational axis r2 of the driven shaft 17 to the outer surface of the outer seal portion 71*b*, the area with the radius from the rotational axis r2 of the driven shaft 17 to the main lip portion 71*a*. The thickness of the third seal member 52 is the sum of the thicknesses of the first close contact portion 821*c*, the second close contact portion 822*c*, the flange portion 81*c*, and the held portion 83*b* of the third seal member 52. The thickness of each of the first seal member 32 and the second seal member 42 is the sum of the thicknesses of the seal connection portion 71*c*, the flange portion 73*b*, the held portion 72*a*, and the second holding portion 74*b*.

This structure allows the third seal member 52 to seal the space between the gear chamber 24 and the motor chamber 23 to a lesser extent than the first seal member 32 and the second seal member 42 seal the space between the gear chamber 24 and the rotor chamber 25. Accordingly, in this structure, for example, the third seal member 52 does not have to include the first helical groove 53.

In the embodiment, the first seal member 32, the second seal member 42, and the third seal member 52 may be arranged such that the third seal member 52 has a higher permeability than the first seal member 32 and the second seal member 42. In the embodiment, the material of the seal body 71 of each of the first seal member 32 and the second seal member 42 and the material of the rubber member 82 of the third seal member 52 may be changed such that the third seal member 52 has a higher permeability than the first seal member 32 and the second seal member 42.

In this structure, since the third seal member 52 has a higher permeability than the first seal member 32 and the second seal member 42, the third seal member 52 seals the space between the gear chamber 24 and the motor chamber 23 to a lesser extent than the first seal member 32 and the second seal member 42 seal the space between the gear chamber 24 and the rotor chamber 25. Accordingly, in this structure, for example, the third seal member 52 does not have to include the first helical groove 53.

In the embodiment, pitch P1 of the first helical groove 53 does not have to be fixed.

In the embodiment, depth D1 of the first helical groove 53 does not have to be fixed from the first end to the second end of the first helical groove 53.

In the embodiment, pitch P1 of the first helical groove 53 may be smaller than depth D1 of the first helical groove 53.

In the embodiment, pitch P1 of the first helical groove 53 may have the same dimension as depth D1 of the first helical groove 53.

In the embodiment, the first helical groove 53 does not need to have a triangular cross-section and may have, for example, an arcuate cross-section. In short, as long as the first helical groove 53 connects the inside of the gear chamber 24 to the inside of the motor chamber 23, the shape of the first helical groove 53 is not particularly limited.

In the embodiment shown in FIG. 7, the second helical groove 93 does not need to have a triangular cross-section and may have, for example, an arcuate cross-section. In short, as long as the second helical groove 93 connects the inside of the gear chamber 24 to the inside of the motor chamber 23, the shape of the second helical groove 93 is not particularly limited.

Figure 8:
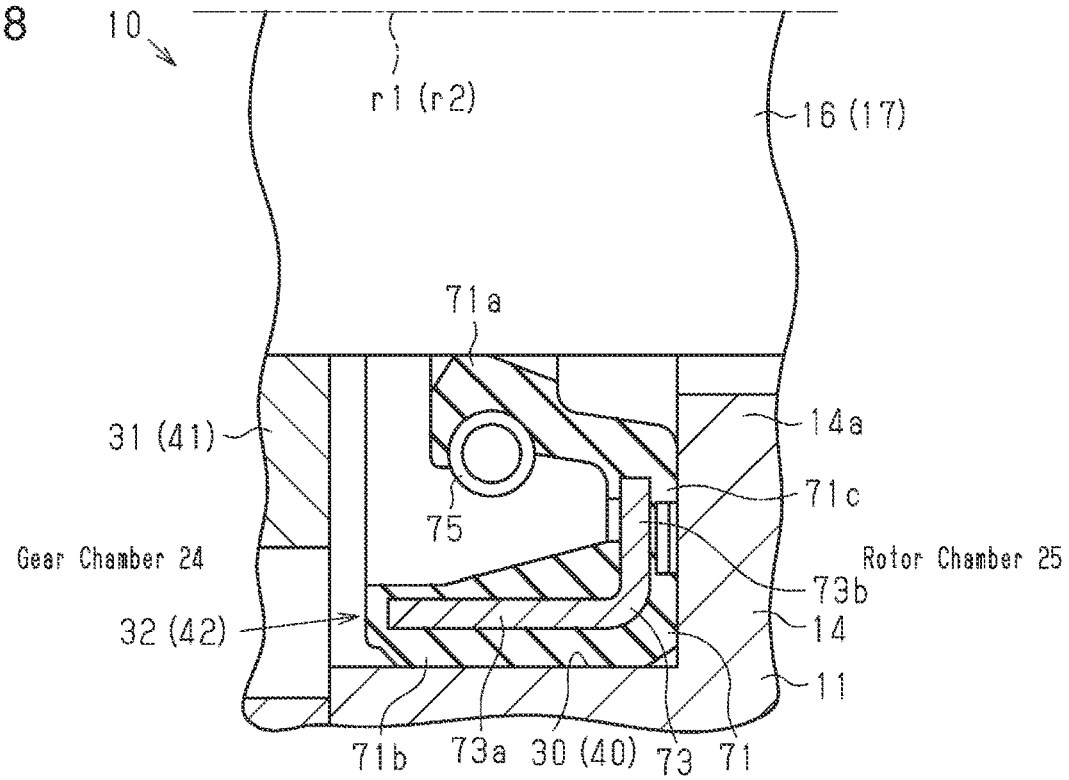
FIG. 8 is a cross-sectional view showing the relationship between the first seal member and the driving shaft in a further embodiment.

As shown in FIG. 8, the first seal member 32 and the second seal member 42 do not have to include the lip member 72 and the holding member 74. As shown in FIG. 8, in the first seal member 32 and the second seal member 42, the seal connection portion 71*c* may extend toward the inner side of the seal body 71 in the radial direction from the end of the inner portion of the outer seal portion 71*b* closer to the rotor chamber 25. Thus, the extending direction of the outer seal portion 71*b* from the seal connection portion 71*c* may be the same as the extending direction of the main lip portion 71*a* from the seal connection portion 71*c*.

Figure 9:
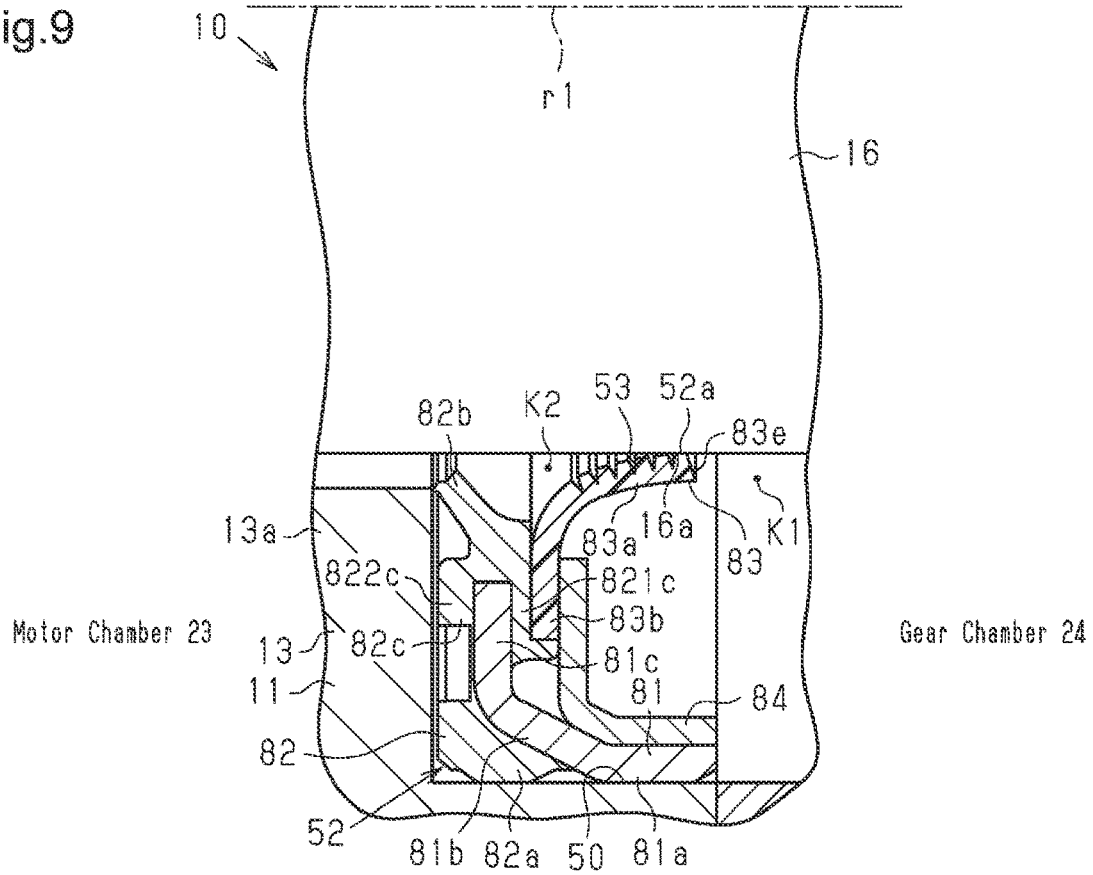
FIG. 9 is a cross-sectional view showing the relationship between the third seal member and the driving shaft in yet another embodiment.

As shown in FIG. 9, in the third seal member 52, the main lip member 83 may be held by an annular holding member 84 made of metal.

In the embodiment, the electric pump 10 may have a structure in which the motor housing member 12 does not include the discharge passage 90.

In the embodiment, the driving rotor 20 and the driven rotor 21 may be shaped, for example, as three lobes or four lobes in a cross-sectional view that is orthogonal to the rotational axial directions of the driving shaft 16 and the driven shaft 17.

In the embodiment, the driving rotor 20 and the driven rotor 21 may be, for example, helical.

In the embodiment, the electric pump 10 does not have to be a fuel cell hydrogen pump that supplies hydrogen gas to fuel cells and may be used for other purposes. In short, the fluid drawn into the rotor chamber 25 is not limited to hydrogen gas.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An electric pump, comprising:

a driving shaft including a rotational axis;

a driving rotor and a driven rotor that are driven by rotation of the driving shaft;

a driven shaft configured to rotate the driven rotor;

a driving gear disposed on the driving shaft, the driving gear being configured to transmit the rotation of the driving shaft;

a driven gear disposed on the driven shaft, the driven gear being configured to transmit the rotation of the driving shaft;

an electric motor configured to rotate the driving shaft; and a housing that includes a gear chamber, a rotor chamber, and a motor chamber, the gear chamber accommodating the driving gear and the driven gear and encapsulating oil supplied to the driving gear and the driven gear, the rotor chamber accommodating the driving rotor and the driven rotor, the motor chamber accommodating the electric motor, wherein the motor chamber, the gear chamber, and the rotor chamber are arranged in order in a rotational axial direction of the driving shaft, the housing includes a first partition wall that separates the gear chamber from the rotor chamber and a second partition wall that separates the gear chamber from the motor chamber, the first partition wall includes a first through-hole through which the driving shaft passes and a second through-hole through which the driven shaft passes, the second partition wall includes a third through-hole through which the driving shaft passes, the electric pump further comprises:

a first seal member arranged in the first through-hole to seal a space between the gear chamber and the rotor chamber;

a second seal member arranged in the second through-hole to seal the space between the gear chamber and the rotor chamber; and a third seal member arranged in the third through-hole to seal a space between the gear chamber and the motor chamber, the third seal member seals the space between the gear chamber and the motor chamber to a lesser extent than the first seal member and the second seal member seal the space between the gear chamber and the rotor chamber, the third seal member includes a seal surface adjacent to the driving shaft, the seal surface including a first helical groove, and the first helical groove connects an inside of the gear chamber to an inside of the motor chamber.

2. The electric pump according to claim 1, wherein the first helical groove has a triangular cross-section.

3. The electric pump according to claim 1, wherein an area of the third seal member in contact with the third through-hole is smaller than an area of the first seal member in contact with the first through-hole and an area of the second seal member in contact with the second through-hole.

4. The electric pump according to claim 1, wherein an area of the third seal member projected on the third through-hole in the rotational axial direction of the driving shaft is larger than an area of the first seal member projected on the first through-hole in the rotational axial direction of the driving shaft and an area of the second seal member projected on the second through-hole in the rotational axial direction of the driving shaft, and the third seal member has a smaller thickness than the first seal member and the second seal member.

5. The electric pump according to claim 1, wherein the third seal member has a higher permeability than the first seal member and the second seal member.

6. The electric pump according to claim 1, wherein the housing includes a discharge passage that connects an inside of the motor chamber to an outside of the housing, and the discharge passage includes a valve member that discharges fluid from the inside of the motor chamber to the outside of the housing.

7. An electric pump, comprising:

a driving shaft including a rotational axis;

a driving rotor and a driven rotor that are driven by rotation of the driving shaft;

a driven shaft configured to rotate the driven rotor;

a driving gear disposed on the driving shaft, the driving gear being configured to transmit the rotation of the driving shaft;

a driven gear disposed on the driven shaft, the driven gear being configured to transmit the rotation of the driving shaft;

an electric motor configured to rotate the driving shaft; and a housing that includes a gear chamber, a rotor chamber, and a motor chamber, the gear chamber accommodating the driving gear and the driven gear and encapsulating oil supplied to the driving gear and the driven gear, the rotor chamber accommodating the driving rotor and the driven rotor, the motor chamber accommodating the electric motor, wherein the motor chamber, the gear chamber, and the rotor chamber are arranged in order in a rotational axial direction of the driving shaft, the housing includes a first partition wall that separates the gear chamber from the rotor chamber and a second partition wall that separates the gear chamber from the motor chamber, the first partition wall includes a first through-hole through which the driving shaft passes and a second through-hole through which the driven shaft passes, the second partition wall includes a third through-hole through which the driving shaft passes, the electric pump further comprises:

a first seal member arranged in the first through-hole to seal a space between the gear chamber and the rotor chamber;

a second seal member arranged in the second through-hole to seal the space between the gear chamber and the rotor chamber; and a third seal member arranged in the third through-hole to seal a space between the gear chamber and the motor chamber, the third seal member seals the space between the gear chamber and the motor chamber to a lesser extent than the first seal member and the second seal member seal the space between the gear chamber and the rotor chamber, the driving shaft includes a sliding surface adjacent to the third seal member, the sliding surface including a second helical groove, and the second helical groove connects an inside of the gear chamber to an inside of the motor chamber.

8. The electric pump according to claim 7, wherein the second helical groove has a triangular cross-section.

9. The electric pump according to claim 7, wherein an area of the third seal member in contact with the third through-hole is smaller than an area of the first seal member in contact with the first through-hole and an area of the second seal member in contact with the second through-hole.

10. The electric pump according to claim 7, wherein an area of the third seal member projected on the third through-hole in the rotational axial direction of the driving shaft is larger than an area of the first seal member projected on the first through-hole in the rotational axial direction of the driving shaft and an area of the second seal member projected on the second through-hole in the rotational axial direction of the driving shaft, and the third seal member has a smaller thickness than the first seal member and the second seal member.

11. The electric pump according to claim 7, wherein the third seal member has a higher permeability than the first seal member and the second seal member.

12. The electric pump according to claim 7, wherein the housing includes a discharge passage that connects an inside of the motor chamber to an outside of the housing, and the discharge passage includes a valve member that discharges fluid from the inside of the motor chamber to the outside of the housing.

* * * * *